US005749460A

United States Patent [19]

Rice

[11] Patent Number: 5,749,460

[45] Date of Patent: May 12, 1998

[54] UNDERCUP ASSEMBLY

[75] Inventor: Michael J. Rice, St. Paul, Minn.

[73] Assignee: The Pillsbury Company, Minneapolis, Minn.

[21] Appl. No.: 469,195

[22] Filed: Jun. 6, 1995

[51] Int. Cl.[6] ..... B65D 21/02; B65D 51/28

[52] U.S. Cl. ..... 220/23.83; 220/522; 215/6; 215/10

[58] Field of Search ..... 215/6, 10, 231; 220/23.83, 522

[56] References Cited

U.S. PATENT DOCUMENTS

| | | | |
|---|---|---|---|
| 2,352,951 | 7/1944 | Geria | 220/522 X |
| 2,721,552 | 10/1955 | Nosik | 215/6 X |
| 2,739,751 | 3/1956 | Bailey . | |
| 2,766,796 | 10/1956 | Tupper | 215/6 X |
| 2,936,089 | 5/1960 | Goldfarb et al. | 215/6 |
| 2,938,518 | 5/1960 | Horrocks | 215/6 X |
| 2,941,689 | 6/1960 | Black | 215/6 X |
| 2,949,369 | 8/1960 | Zoeller et al. | 99/172 |
| 3,163,544 | 12/1964 | Valyi | 99/171 |
| 3,182,890 | 5/1965 | Elam | 229/51 |
| 3,312,262 | 4/1967 | Hunter | 150/5 |
| 3,385,503 | 5/1968 | Stump | 229/15 |
| 3,442,435 | 5/1969 | Ludder et al. | 220/23.83 X |
| 3,506,459 | 4/1970 | Parlour | 99/172 |
| 3,779,372 | 12/1973 | De Lloret | 215/6 X |
| 3,851,757 | 12/1974 | Turpin | 206/223 |
| 3,957,653 | 5/1976 | Blecher | 220/522 X |
| 3,962,476 | 6/1976 | Turpin | 426/398 |
| 4,007,936 | 2/1977 | Hornsby, Jr. | 220/522 X |
| 4,024,952 | 5/1977 | Leitz | 215/6 X |
| 4,074,827 | 2/1978 | Labe, III | 220/522 |
| 4,114,784 | 9/1978 | Hough et al. | 220/408 |
| 4,221,291 | 9/1980 | Hunt | 215/6 X |
| 4,264,007 | 4/1981 | Hunt | 215/6 X |
| 4,279,351 | 7/1981 | Vertes | 215/231 |
| 4,874,618 | 10/1989 | Seaborne et al. | 426/76 |
| 5,096,078 | 3/1992 | McQueeny | 215/231 |
| 5,099,998 | 3/1992 | Curzon et al. | 215/10 X |
| 5,419,429 | 5/1995 | Zimmerman et al. | 215/6 X |

FOREIGN PATENT DOCUMENTS 2040864 9/1980 United Kingdom .

*Primary Examiner*—Sue A. Weaver
*Attorney, Agent, or Firm*—Aleya Rahman; Janal M. Kalis

[57] ABSTRACT

The present invention comprises a cap assembly that includes a cap with a single annular lug that has a retaining surface and an annular flange attachable to the cap by contact with the retaining surface.

4 Claims, 4 Drawing Sheets

21
20
18
26
31

50
A
52
12
21
26
31
16

15
17

UNDERCUP ASSEMBLY

BACKGROUND OF THE INVENTION

The present invention relates generally to a multiple compartment package for use in the packaging of food. More particularly, the present invention relates to a multiple compartment package for separately packaging at least two different articles.

Consumers today rely upon food that can be rapidly prepared at home. Rapid preparation depends upon food that is pre-prepared to a degree where consumers may merely transfer and heat the food. One type of pre-made food enjoyed by consumers is pre-made dough.

Refrigerated, pre-made dough products are very popular because they enable consumers to enjoy home baked goods without expending the time and effort needed to prepare the dough. These refrigerated doughs range from doughs with substantial leavening such as biscuits and breads to doughs of minimal leavening such as cookie dough.

It is desirable to consumers and food manufacturers to package food such as refrigerated dough products with other foods commonly used with the dough to make a final food product. Unfortunately, these other foods frequently cannot be packaged in direct contact with dough in a single container. For example, foods having a semi-fluid state at ambient temperature, such as icing or butter, are not compatible with a semi-solid state food, such as dough, because moisture and oil migration from the icing or butter into the dough destroy final baked product integrity and organoleptic qualities, such as firmness or palatability. Also, the icing integrity is destroyed when the dough is heated.

Additionally, foods such as cookie doughs, icings, and "sprinkles" are not compatible because the "sprinkles" dissolve and diffuse into either the cookie dough or icing. By the term "sprinkles" is meant particles applied to the surface of a dough, such as colored sugar particles, and small candy-like morsels having a variety of shapes and flavors.

It is also desirable to package non-edible materials with an edible material such as cookie dough. The non-edible materials include toys and novelties such as cookie cutters, figurines and so on.

Further, food products having multiple constituents, such as sprinkles and dough, require different conditions for packaging and storage. For instance, foods such as sprinkles are packaged under ambient temperatures and low moisture conditions using gravity loading methods. However, other foods, such as dough, require packaging under cool or warm temperatures. The packaged dough is subsequently stored under refrigeration. Refrigerated dough storage containers may include multi-layers spirally wound or convolute paper containers, as well as plastic and aluminum cans.

The Turpin patent, U.S. Pat. No. 3,851,757, describes a multiple compartment container having a cylindrical container portion with a closed end and an open end opposite the closed end. A cup is inserted into the open end of the cylindrical container portion and is filled with a desired product. Next, a separator plate is placed over the cup and dough is inserted into the cylindrical container portion. The cylindrical container portion is then sealed and the dough is proofed. Proofing causes the dough to expand in the container and to force the separator plate against the cup to prevent the product in the cup from mixing with the dough. One disadvantage of the container described in the Turpin patent is that placing the cup in the cylindrical container portion increased the complexity of packaging the dough and limited the conditions under which the dough could be packaged.

Another multiple compartment container for packaging incompatible food components is described in the Parlour patent, U.S. Pat. No. 3,506,459. In the Parlour patent, a cylindrical container has a first end and a second end opposite the first end. The first end includes a closure element that includes a circular lip that defines a central opening to the cylindrical container. A cup having a main body and a flange at one end of the main body is inserted into the first end of the cylindrical container. The flange permits the main body of the cup to pass through the central opening of the cylindrical container but prevents the cup from passing through the lip of the closure element. A separating plate is positioned over the cup to cover the cup. A seal formed between the lip of the closure element of the cylindrical container and the flange of the cup allows gas to escape from the container while dough undergoes a proofing step and expands. However, if the dough has not leavened sufficiently to force the separating plate against the icing cup, the cup contents may leak thereby destroying dough developing and container integrity.

Similarly to the packaging described in the Turpin patent, pressure from the expanding dough forces the separating plate against the cup and thereby prevents a food stored in the cup from intermixing with the dough. However, if the dough has not expanded sufficiently to force the separating plate against the cup, the contents of the cup may be mixed with the dough and thereby degrade the quality of the dough.

SUMMARY OF THE INVENTION

The package of the present invention includes a first container with an end having a rim. The package also includes a cap having a single annular lug with an interference surface. The cap is positioned on the end having the rim and is held in place by the lug contact with the container. The present invention also includes a cap assembly. The cap assembly includes a cap with a single annular lug that has an interference surface and an annular flange attachable to the cap by contact with the interference surface.

The present invention also includes a method for packaging an article with dough. The method includes providing a cap assembly that includes a cap with a single annular lug that has an interference surface and an annular flange that is attachable to the cap by contact with the interference surface. The method also includes providing a container that contains dough and attaching the cap assembly to the container to form a compartment. The article is positioned in the compartment.

DESCRIPTION OF THE DRAWINGS

FIG. 7 is a side view of one embodiment of the interference lug of the present invention.

FIG. 8 is a side view of one embodiment of the overcap of the present invention.

DETAILED DESCRIPTION OF PREFERRED EMBODIMENTS

Figure 1:
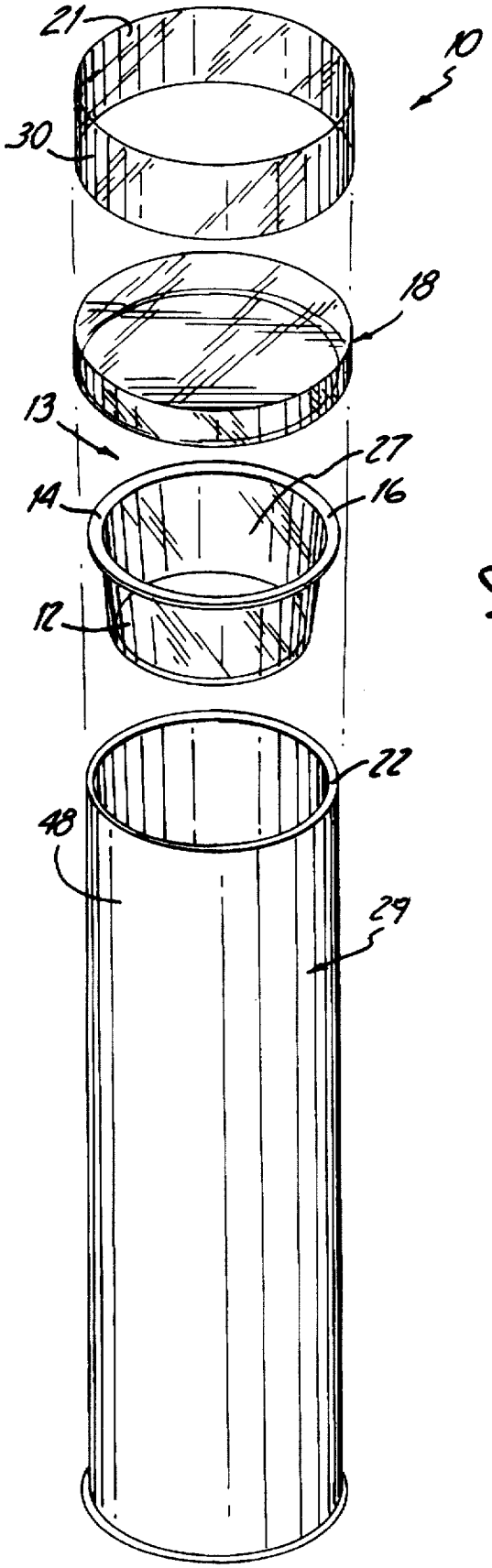
FIG. 1 is an exploded view of one embodiment of the package of the present invention.

The multiple-compartment package of the present invention illustrated generally at 10 in FIG. 1 includes an undercup assembly 13 with an undercup 12 having a first end 14 terminating in an annular flanged lip 16 and an overcap 18 with a single annular lug 20 for retaining the undercup 12 at the flanged lip 16. The package 10 also includes a canister 24 with a rim 22. The undercup 12 of the undercup assembly 13 is positioned within the canister 24 with the flanged lip 16 resting on the rimmed end 22 of the canister 24. The overcap 18 overlays and rests upon the rim 22 of the canister 24. The undercup assembly 13 with overcap 18 is sealed to the canister 24 with a seal such as 30.

The multiple-compartment package 10 of the present invention solves a problem of how to efficiently deliver materials incompatible with a dough material within a single package. It has surprisingly been found that by providing the overcap 18 and by adjusting the size, position, and symmetry of the single lug 20 on the overcap 18, that an undercup 12 may be efficiently secured to the overcap 18 at the annular, flanged lip 16 of the undercup 12.

Figures 4, 5, 6:
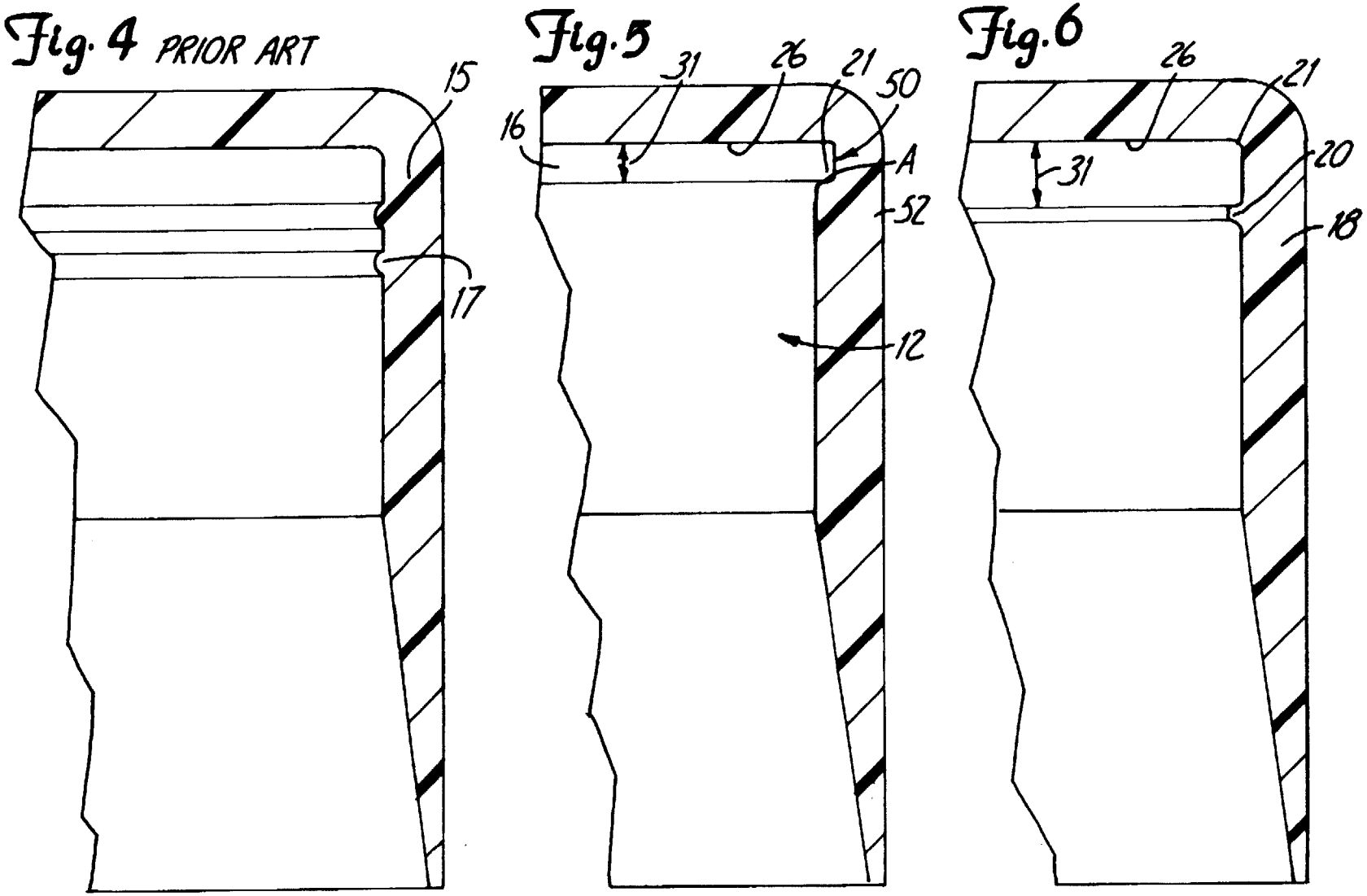
Fig. 4 PRIOR ART
FIG. 4 is a cross-sectional view of a prior art overcap for an undercup assembly.
FIG. 5 is a cross-sectional view of one overcap for an undercup assembly of the present invention.
FIG. 6 is a cross-sectional view of one other overcap for the undercup assembly of the present invention.

The single lug 20 of the present invention is an improvement over a conventional, prior art lug arrangement such as is shown in FIG. 4. The prior art lug arrangement includes two small annular lugs 15 and 17. The two lug prior art design does not secure an undercup assembly as effectively as the single lug of the present invention.

It is most preferred that the dough used in the multiple-compartment package 10 of the present invention be a dough that does not substantially generate gases or substantially leaven at an elevated temperature inside the canister 24 during storage. One preferred dough is a cookie dough. One other preferred dough is a dough that has been substantially completely leavened prior to closing the canister 24.

Figure 2:
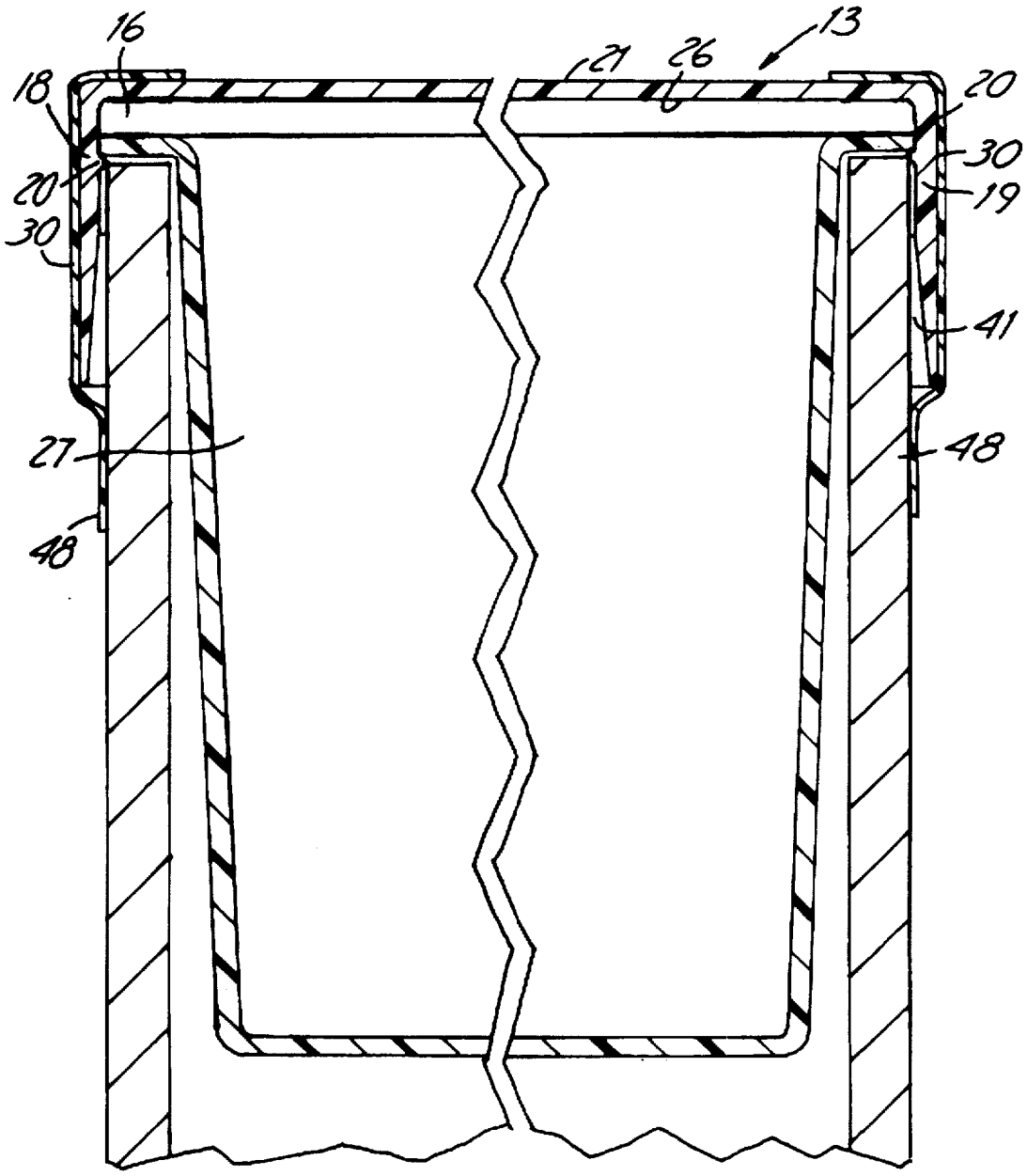
FIG. 2 is a cross-sectional view of one embodiment of the package of the present invention.

In one preferred embodiment, illustrated in FIG. 2, the overcap 18 has a top, circular section 21 and a single, integral annular lug 20, each of which are attached to an annular side 19. Preferably, the annular lug 20 is on an inside surface 41 of the annular side 19, as shown in side view in FIG. 8. In addition to the lug 20, the annular side 19 also includes a section of substantially uniform thickness 45 and a tapered section 43 integral with the uniform section. In one embodiment, the tapered section 43 has a taper that is about 6 degrees.

The lug 20, shown in FIG. 7 has three integral surfaces A, B, and C of different curvature. The lug 20 has an apex 25 where the surface B is at its greatest extension. The lug 20 and overcap 18 are made of a material having an elasticity. In one embodiment, the overcap 18 is made of polypropylene. The symmetry of the lug 20 along with the elasticity of the lug 20 interferes with movement of the flange 16 and captures and retains the flange 16 of the undercup 12 or an outer surface of the canister 24. Once the flange 16 is captured, forces in the lug 20 and overcap 18 generally, hold the flange 16 in place.

A clearance distance 31 between the top circular section 21 of the overcap 18 and the surface A of the lug 20 is adjustable in the manufacture of the overcap 18 in accordance with the thickness of the flange 16. In one embodiment, the distance between the surface A of the lug 20 and a lower surface 26 of the top circular section 21 is about 0.020 inches. One preferred distance between the apex 25 of the lug 20 and the lower surface 26 of the top circular section 21 is about 0.030 inches. One other preferred distance is 0.040 inches. One preferred vertical distance 33 between the apex 25 of the lug 20 and the surface C is about 0.008 inches, as shown in FIG. 7.

The annular lug 20 may be a continuous lug extending circumferentially about the overcap 18. The annular lug 20 may also be a plurality of discrete lug segments extending circumferentially about the overcap 18 on the annular side 19 of the overcap 18. Each segment of the lug 20 has the three surfaces A, B and C.

The undercup 12 is preferably made by a conventional solid phase pressure formed process to economize on materials. In one embodiment, the undercup 12 has an annular wall 23 with a thickness of about 0.015 to about 0.020 inches. The undercup 12 has an unflanged diameter of about 2.100 inches and a flanged outer diameter of about 2.315 inches. The flange thickness is about 0.025 inches. The flanged lip 16 of the undercup 12 is capable of flexible movement when pass ed over the lug 20 into the clearance 31.

The undercup 12 snaps onto the overcap 18 at the lug 20 by flexible movement of the flanged lip 16 across the lug 20 to form a compartment 27. The lug 20 retains the flanged lip 16 in a 25 space between the surface A of the lug 20 and the circular top section 21 of the overcap 18. The compartment 27 is suitable for delivery of any of a number of promotional items or food additives such as decorative sprinkles and icing.

The overcap 18 is positionable on the rim 22 of the composite canister 24 and, in one embodiment, is attached with the seal 30. Also attached with the seal 30 is a canister side wall 48 and the overcap 18.

In one other embodiment, illustrated in FIG. 5, a single, integral annular lug 50 of the overcap 52 is of a notched symmetry. Similarly to the embodiment of FIG. 6, the single, integral notched lug 50 includes the interference, retaining surface A having a width of about 0.008 inches to 0.0100 inches. The notched lug 50 is positioned on the overcap 52 to provide a clearance 31 of about 0.015 inches. The undercup 12 with flanged annular lip 16 is positionable within the clearance 31 so that it is held by the single annular notched lug 50. The notched lug 50 is believed to crack more easily than the lug 20. The embodiment of FIG. 5 may also include the thermally activatable seal 30, not shown, as described.

Figure 3:
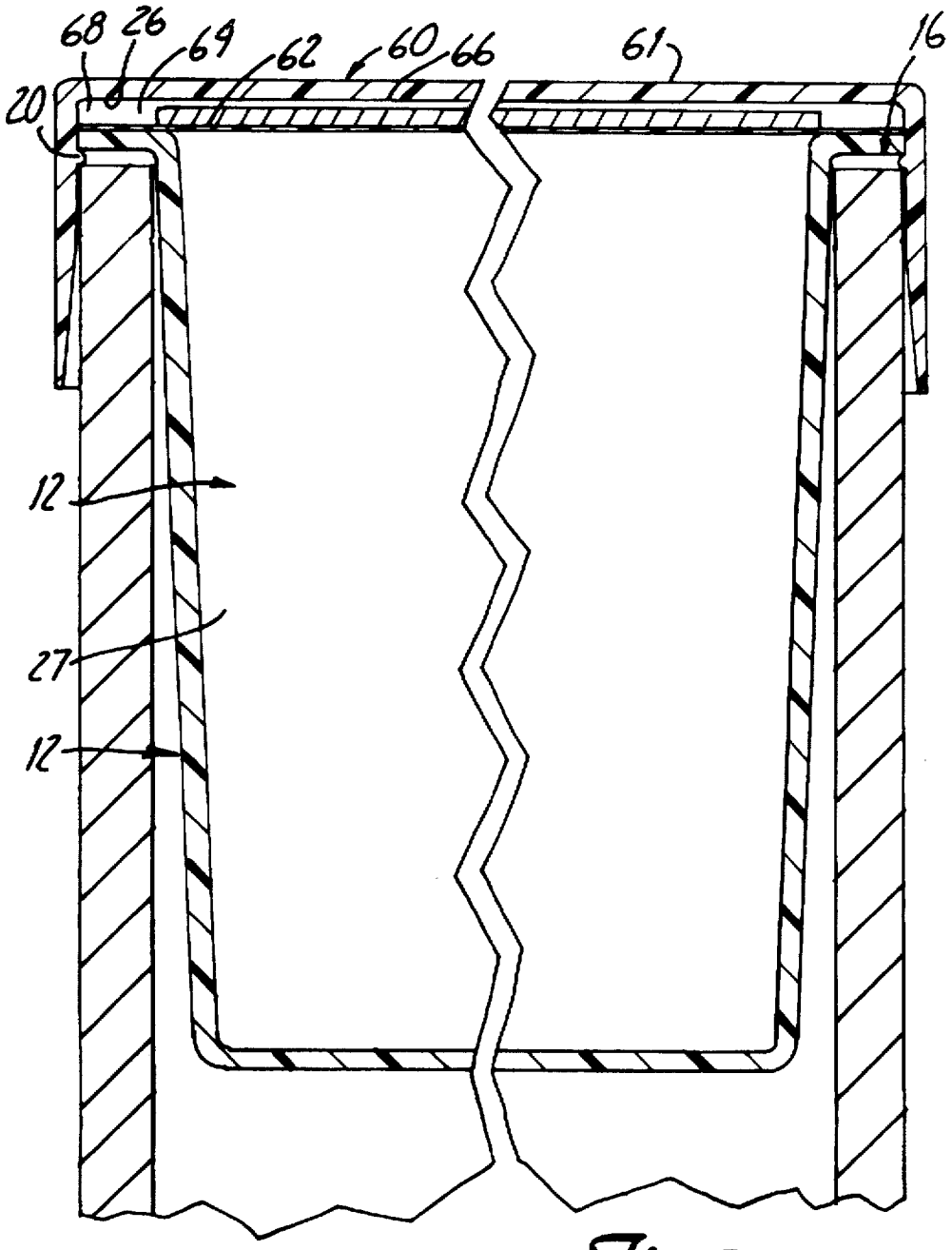
FIG. 3 is a cross-sectional view of one other embodiment of the package of the present invention.

One other embodiment of the package is illustrated at 60 in FIG. 3. In this embodiment, the overcap 61, as shown, includes the lug 20. It is also contemplated, however, that the lug may have the symmetry of lug 50 of FIG. 5. What is important is that the lug have the interference, retaining surface A with a width of about 0.008 inches to 0.0100 inches and provide a clearance 64 of about 0.040 inches between the interference, retaining surface A and the under surface 26 of the overcap 61.

In the embodiment shown in FIG. 3, the flange 16 retained by the overcap 61 is in contact with a film 62, adhered to the flange 16 that covers the undercup 12. It is also contemplated that a disc (not shown) may be positioned on the flange 16 instead of the film 62. Preferably, the disc (not shown) is made with a clear, rigid, plastic material. The film 62 or the disc, not shown, is retained in the clearance 64 by the lug 20.

Another novelty item component 66 may be enclosed by the film 62 or disc, not shown, and overcap 61. Between the film 62 and overcap 61, the novelty item 66 is captured and retained in a compartment 68. The novelty item 66 may include any type of toy of a size and symmetry that is capable of being held within the compartment 68. Toys include game markers, caps, cookie cutters, marbles, cartoons, stickers, tatoos and so on.

The embodiment shown in FIG. 3 shows the overcap 61 retaining both the film 62 and the flanged lip 16 of the container 12. It is understood, however, that the overcap 61 may retain the film 62 or disc alone, free of the container 12. The film 62 or the disc may act as a floor of the compartment 68.

In one embodiment that is not shown, the overcap 61 is held on canister 24 by the seal 30 described previously. The canister 24 may be made of materials that include paper or paperboard, metal or plastic and is preferably of a cylindrical shape. The canister 24 may also include a paper layer such as a label cylindrically attached to its surface.

The seal 30 may be any conventional seal and includes adhesive seals and shrink wrap seals. The seal 30 may also include a tamper evident feature.

Although the present invention has been described with reference to preferred embodiments, workers skilled in the art will recognize that changes may be made in form and detail without departing from the spirit and scope of the invention.

What is claimed is:

1. A package comprising:

a first container that includes a rimmed end;

a cap that includes an elastic annular wall with an annular lug that has a retaining surface, the cap attachable to the first container when the annular lug is retained adjacent to the rimmed end; and a cup with a flexible, flanged rim wherein the cup is attachable to the first container by positioning the flanged rim of the cup to contact the retaining surface of the annular lug.

2. The package of claim 1 and further including a covering attachable to the package by positioning the covering to contact the flanged rim of the cup.

3. The package of claim 1 and further including a seal for attaching the cap to the first container.

4. The package of claim 3 wherein the seal is a tamper evident seal.

* * * * *

UNITED STATES PATENT AND TRADEMARK OFFICE

CERTIFICATE OF CORRECTION

PATENT NO. : 5,749,460

DATED : May 12, 1998

INVENTOR(S) : Michael J. Rice

It is certified that error appears in the above-indentified patent and that said Letters Patent is hereby corrected as shown below:

Col. 4, line 22, between the words "a" and "space", delete the number "25"

Signed and Sealed this

Eighteenth Day of August, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,749,460

DATED : May 12, 1998

INVENTOR(S) : Michael J. Rice

It is certified that error appears in the above-indentified patent and that said Letters Patent is hereby corrected as shown below:

In the Drawings:

Insert Sheet 5 of 5, Fig. 7 and Fig. 8

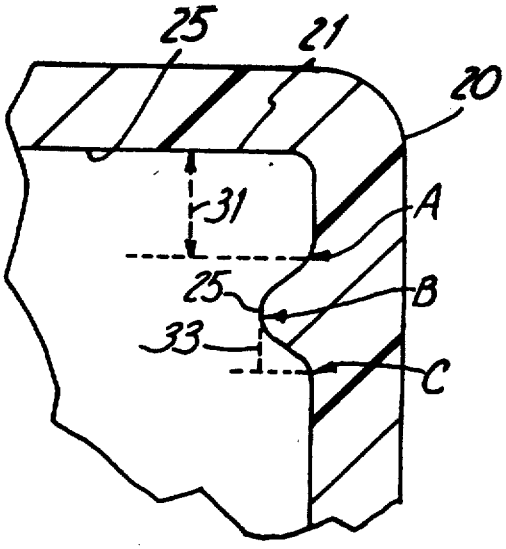

Fig. 7

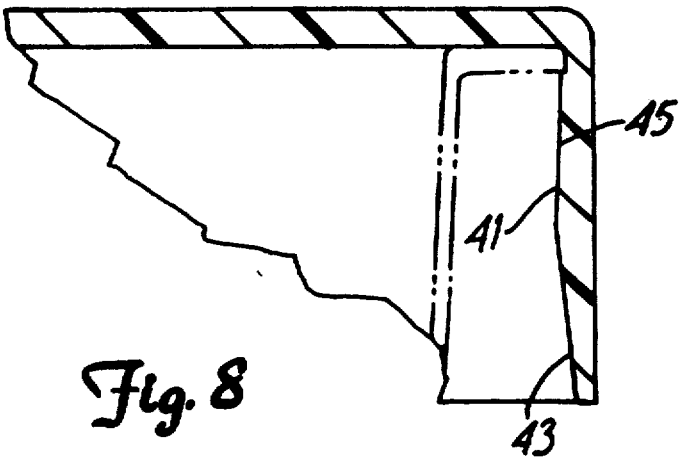

Fig. 8